US005519390A

United States Patent [19]

Casini

[11] Patent Number: 5,519,390

[45] Date of Patent: May 21, 1996

[54] TRAFFIC LIGHT TIMER

[76] Inventor: Peter Casini, 67-39 Clyde St., Forest Hills, N.Y. 11375

[21] Appl. No.: 382,879

[22] Filed: Feb. 2, 1995

[51] Int. Cl.[6] ..... G08G 1/096

[52] U.S. Cl. ..... 340/929; 340/925; 340/944

[58] Field of Search ..... 340/907, 925, 340/929, 944

[56] References Cited

U.S. PATENT DOCUMENTS

| | | | |
|---|---|---|---|
| 3,076,178 | 1/1963 | Hastings | 340/944 |
| 3,234,506 | 2/1966 | Hines | 340/929 |
| 3,320,585 | 5/1967 | Hines . | |
| 3,408,623 | 10/1968 | Wagner et al. . | |
| 4,200,860 | 4/1980 | Fritzinger . | |
| 4,827,258 | 5/1989 | Evans . | |
| 4,914,435 | 4/1990 | Gould et al. | 340/925 |
| 5,136,287 | 8/1992 | Borenstein | 340/925 |
| 5,150,116 | 9/1992 | West | 340/929 |
| 5,241,307 | 8/1993 | Bidault et al. | 340/925 |

FOREIGN PATENT DOCUMENTS

| | | | |
|---|---|---|---|
| 2691566 | 11/1993 | France | 340/929 |
| 2933774 | 3/1981 | Germany | 340/929 |
| 3630623 | 3/1988 | Germany | 340/929 |
| 0622117 | 3/1981 | Switzerland | 340/929 |

*Primary Examiner*—Brent A. Swarthout
*Attorney, Agent, or Firm*—Michael I. Kroll

[57] ABSTRACT

A traffic light timer is provided that provides a visible and accurate warning that a traffic light signal is about to change. The time remaining before the change is displayed in numeric form on a display and visibly counts down the seconds remaining. In one configuration of the invention, the display is alphanumeric. In another configuration the display is graphical allowing for the display of free form icons. The icon library is contained on an easily replaced icon memory module.

1 Claim, 2 Drawing Sheets

TRAFFIC LIGHT TIMER

BACKGROUND OF THE INVENTION

The instant invention relates, generally, to the field of traffic control devices, and, more specifically, to traffic devices that provide additional safety enhancing features.

At the present state of the art, pedestrians that cross traffic signal controlled intersections have no way to determine how much time remains before the traffic signal changes state, especially from green to red. As a result, the pedestrian has to rush across the intersection or risk getting caught in the middle of the intersection as traffic begins to accelerate around him. This places undue physical and psychological stress on the pedestrian and endangers his safety. Also, should the pedestrian be in the intersection when the light turns red, traffic flow will be greatly disrupted.

A number of solutions have been proposed to the above stated traffic control dilemma. For instance, J. Hines (U.S. Pat. No. 3,320,585) proposes a time informing display device that uses a series of lamps to display time information, but does not provide the ability to display easily programmable graphic icons, such as an icon showing an individual walking when the traffic light turns green.

T. Wagner (U.S. Pat. No. 3,408,623) proposes a safety signal light that uses a multiplicity of lighted bars to indicate the time remaining before the signal changes. This method is inexact and requires interpretation by the viewer.

K. Evans (U.S. Pat. No. 4,827,258) proposes a traffic light change anticipation system that uses simultaneous activation of the green with amber and red with amber to alert the observer that the light is about to change. This method is inexact and confusing to the viewer.

G. Fritzinger (U.S. Pat. No. 4,200,860) proposes a method and apparatus for signaling motorists and pedestrians when the direction of traffic will change. This system blinks the existing signal lights to alert the observer that the signal is about to change. This method is also inexact and confusing.

SUMMARY OF THE INVENTION

It is, therefore, a primary object of the present invention to provide a traffic light timer that provides a display of the seconds remaining before a traffic signal turns from green to red or red to green.

Another object is to provide a traffic light timer where the timer display is a part of an alphanumeric display.

Another object is to provide a traffic light timer where the timer display is a part of a graphic display.

A further object is to provide a traffic light timer that can be constructed as an integrated unit or as an appendage to a conventional "WALK/DON'T WALK" sign.

A still further object is to provide a traffic light timer that is easy and inexpensive to fabricate and highly reliable in critical traffic control applications.

Another further object is to provide a traffic light timer that has a programmable icon generator to generate the graphic displays and an easily replaceable icon memory module that allows for easy changes in the icon library.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

COMPONENT LIST

| Numeral | Description |
|---|---|
| 10 | TRAFFIC LIGHT TIMER |
| 12 | Traffic Light Stanchion |
| 14 | Traffic Light Base |
| 16 | Conventional Traffic Light |
| 18 | Upper Support Bar |
| 20 | Lower Support Bar |
| 22 | Alphanumeric Display (Numeric) |
| 24 | Alphanumeric Display (Alpha) |
| 26 | Graphic Display (Icon of person walking) |
| 28 | Conventional "WALK/DON'T WALK" Signal |
| 30 | Numeric Display as Appendage |
| 32 | Conventional Signal Readout |
| 34 | Numeric Readout on Appended Display |
| 36 | Conventional Traffic Timing Circuit |
| 38 | Backward Counting Timer |
| 40 | Graphic or Alphanumeric Display |
| 42 | Graphic Icon Generator |
| 44 | Icon Memory Module |

DETAILED DESCRIPTION OF THE PREFERRED EMBODIMENTS

Figure 1:
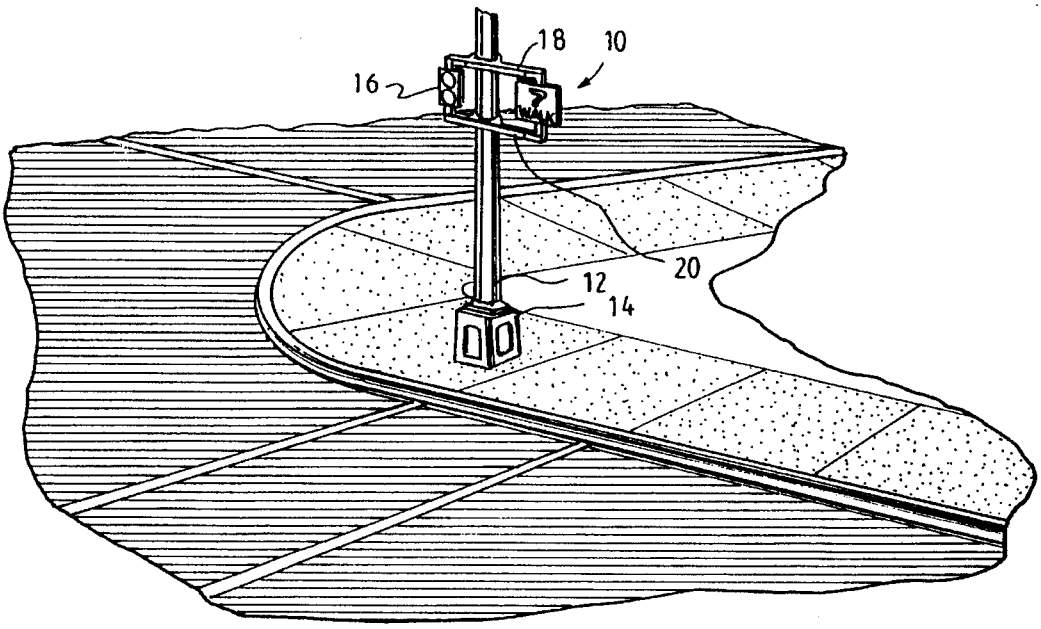
FIG. 1 is an illustrative view of the invention in use at an intersection.

In FIG. 1, the traffic light timer is seen installed at an intersection. The traffic light stanchion 12 is supported by traffic light base 14. An upper support bar 18 and a lower support bar 20 support conventional traffic signal 16 and the invention 10.

Figure 2:
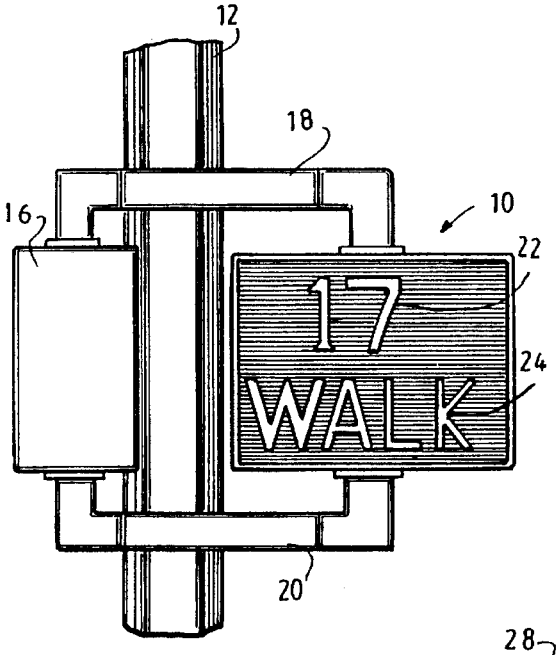
FIG. 2 is an illustration of the invention showing an alphanumeric display.

In one configuration, the display is alphanumeric; that is, the information displayed is confined to numbers and letters, as in FIG. 2. Here the display shows the numeric 17 (22) and the alpha WALK (24).

Figure 3:
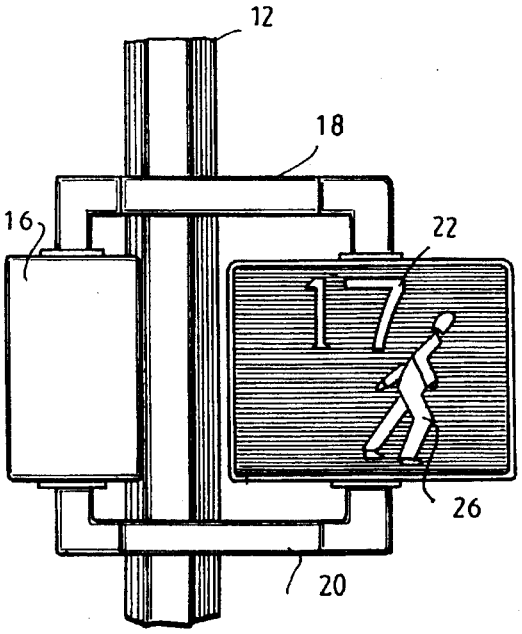
FIG. 3 is an illustration of the invention showing a graphical display.

In another configuration, the display is graphical; that is the information can be presented in a free form manner, as in FIG. 3. Here the graphic icon of a walking man 22 is displayed along with either a graphical or alphanumeric form of the number 17 (22).

Figure 4:
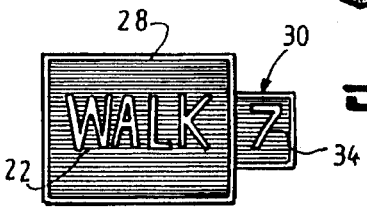
FIG. 4 is an illustration of an alternative embodiment of the invention showing the timer as an appendage to a conventional "WALK/DON'T WALK" sign.

In yet another configuration, the numeric display 34 is appended to a conventional "WALK/DON'T WALK" display 32 as in FIG. 4.

Figure 5:
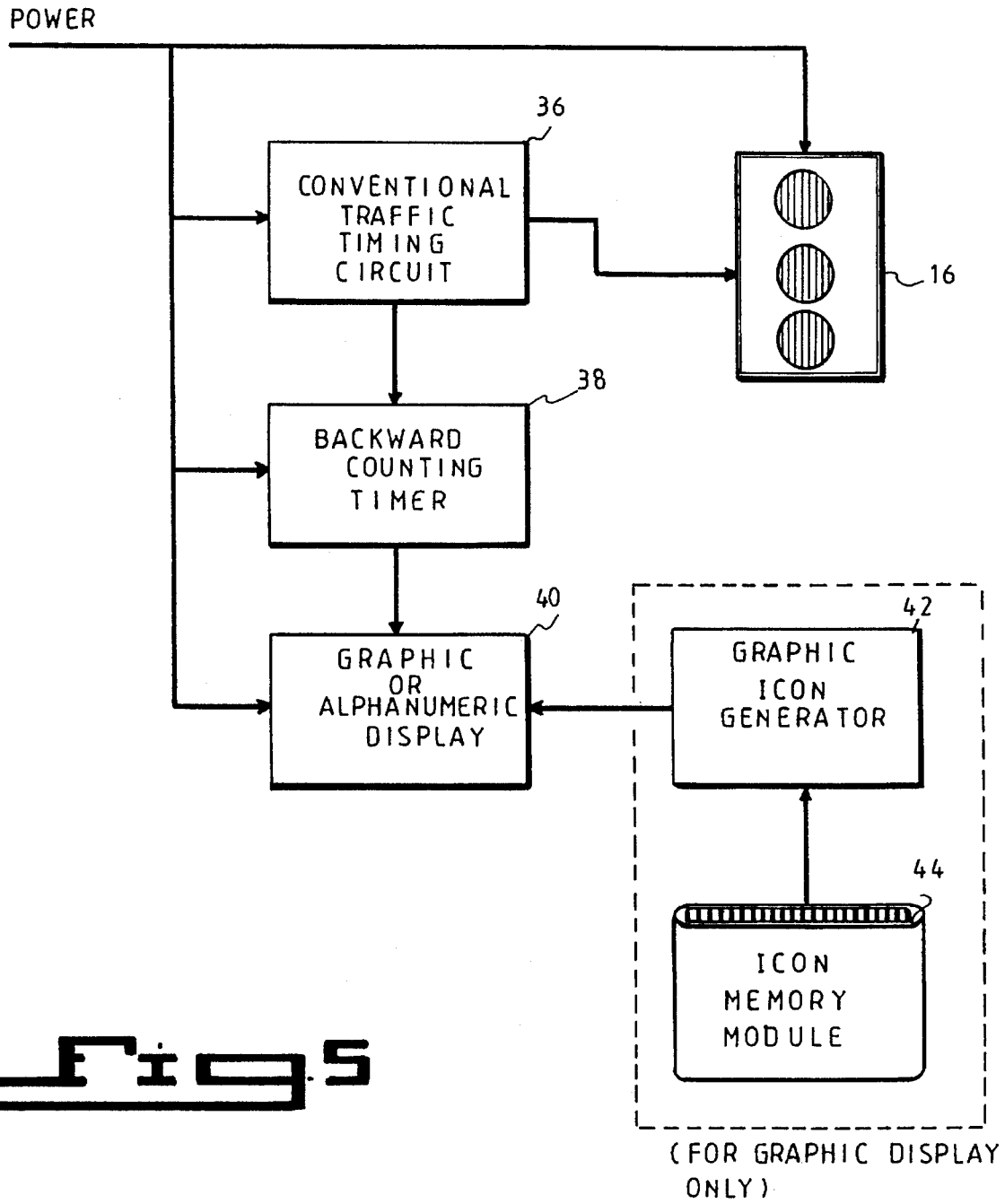
FIG. 5 is an electronic block diagram of the invention.

The detailed operation of the invention is best understood with reference to FIG. 5. A conventional traffic timing circuit 36 operates a conventional traffic signal 16, automatic cycling the light through green, to amber, to red, and back to green again. An output of conventional timer 36 is used to initiate the operation of backward counting timer 38. The initial count is equal to the number of seconds until the next changeover of signal. The timer then counts down towards zero.

The graphic or alphanumeric display 40 can either be a simple alphanumeric display as per numerals 22/24 or it can be a free form graphic display, as per numerals 22/26. If a graphic display is used, graphic icon generator 42 provides the electronic signals needed to drive display 40 and icon memory module 44 provides the library of graphic icon images (i.e. a person crossing a street). Icon memory module 44 is easily removed and replaced to allow changing icons easily.

Graphic or alphanumeric display 40 may be a light emitting diode (LED) display, a liquid crystal (LCD) display, a cathode ray tube (CRT) display, or a gas plasma display.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A traffic light timer comprising:

a. traffic timing circuit means mounted at a traffic intersection for controlling vehicle and pedestrian flow across said intersection including red, yellow, and green traffic lights;

b. backward counting timer means initiated each time the timing circuit means switches states;

c. graphics generating means for producing graphics and pictorial icons for pedestrians corresponding to a traffic light being energized including memory module means for storing said icons, said memory module means being easily removable and replaceable to allow easy changing of icons;

d. means comprising a rectangular shaped member having a pair of spaced vertical legs for mounting said timing circuit means including traffic lights on one vertical leg and said backward counting timer means and said graphic generating means on the other vertical leg for continuously displaying the time, in seconds, remaining before said traffic timing circuit means again changes state and graphics including an appropriate pictorial icon together in a single display facing oncoming pedestrian traffic.

* * * * *